United States Patent [19]

Mahaffy et al.

[11] 4,085,565

[45] Apr. 25, 1978

[54] PACKAGING APPARATUS FOR FORMING SPECIALLY SHAPED PACKAGES

[75] Inventors: Reid A. Mahaffy, Montclair; Joseph M. Psota, Hawthorne; John A. Giordano, West Paterson, all of N.J.

[73] Assignee: Mahaffy & Harder Engineering Co., Totowa, N.J.

[21] Appl. No.: 748,650

[22] Filed: Dec. 8, 1976

[51] Int. Cl.[2] ..... B65B 31/02

[52] U.S. Cl. ..... 53/112 A; 53/22 A

[58] Field of Search ..... 53/112 A, 112 R

[56] References Cited

U.S. PATENT DOCUMENTS

| | | | |
|---|---|---|---|
| 3,522,687 | 8/1970 | Mahaffy | 53/112 A X |
| 3,659,393 | 5/1972 | Richter | 53/112 A X |
| 3,754,372 | 8/1973 | Perdue | 53/112 R |

*Primary Examiner*—Travis S. McGehee

*Attorney, Agent, or Firm*—Parmelee, Johnson, Bollinger & Bramblett

[57] ABSTRACT

Packaging apparatus for making hermetically sealed vacuum packages from two continuous webs of plastic packaging material supplied as roll stock. The lower web is formed into product receptacles, and the upper web is applied over the receptacles to serve as the top. The apparatus includes a single-station evacuate-and-seal head where the two webs are initially sealed together around the flanges of the receptacle. The resulting package is then evacuated through a slit in the lower web, and the evacuation slit is sealed off to complete the package. During evacuation, the upper web is shifted up to engage a heated plate to raise the web temperature to a level permitting forming of the plastic material. After final sealing, the spaces above and below the packages are sequentially vented to atmosphere so as to control the formation of the upper web to produce a crowned effect, wherein a portion of the product extends upwardly a small distance above the flanges of the package.

5 Claims, 7 Drawing Figures

PACKAGING APPARATUS FOR FORMING SPECIALLY SHAPED PACKAGES

BACKGROUND OF THE INVENTION

1. Field of the Invention

This invention relates to packaging apparatus. More particularly, this invention relates to the making of packages from two continuous webs of plastic packaging material, wherein the final package has a shape configured for improved handling or other purposes.

2. Description of the Prior Art.

Packaging apparatus is known for converting continuous web roll stock into sealed packages. A wide variety of machines have been disclosed for this general purpose. For example, U.S. Pat. No. 3,805,486 shows one such machine wherein a bottom web of flexible packaging material is transported in a horizontal direction by means of edge-clamp conveyors, the web being operated on at successive stations to produce product-receiving receptacles. A top web of semi-rigid material is simultaneously transported along a generally circular path by means of a rotary turret having means to form the web into cups which at a station just beneath the turret, are mated, in inverted disposition, with the lower web receptacles carrying the product. The package thus defined is evacuated and sealed. When the evacuation head is evacuated, the atmospheric pressure beneath the flexible lower web forces the web and product up against the inner top surface of the inverted semi-rigid cup. In carrying out this procedure, the evacuated spaces beneath the lower web were evacuated first, and then the spaces above the upper web were evacuated.

SUMMARY OF THE INVENTION

In an embodiment of the invention to be described below in detail, there is provided packaging apparatus having conveyor means for transporting a bottom web of flexible packaging material past a series of operating stations. Conventional means are used to form this web into productreceiving receptacles. After the product has been placed in the receptacle, the web is advanced to an operating station where an unformed top web of flexible packaging material is laid over the product and the bottom web. This operating station includes an evacuation and seal head having vertically-reciprocable upper and lower members. The two members are brought together to make an initial heat-seal between the two webs along a flange area around the receptacle mouth, and to form an evacuation chamber to evacuate the package through an evacuation slit in the bottom web. During this operation, the top film is drawn up to an inner heated surface of the upper member to raise the web temperature to a level providing for subsequent forming. After evacuation is complete, a final heat seal is made to form an hermetically sealed package. Thereafter, the spaces above and below the package are sequentially vented. The resulting final package has a "crowned" configuration, wherein upper portions of the product are located above the flange line where the two plastic sheets are sealed together.

Other objects, aspects, and advantages of the invention will in part be pointed out in, and in part apparent from the following detailed description considered together with the accompanying drawings.

DETAILED DESCRIPTION OF THE PREFERRED EMBODIMENT

Figure 1:
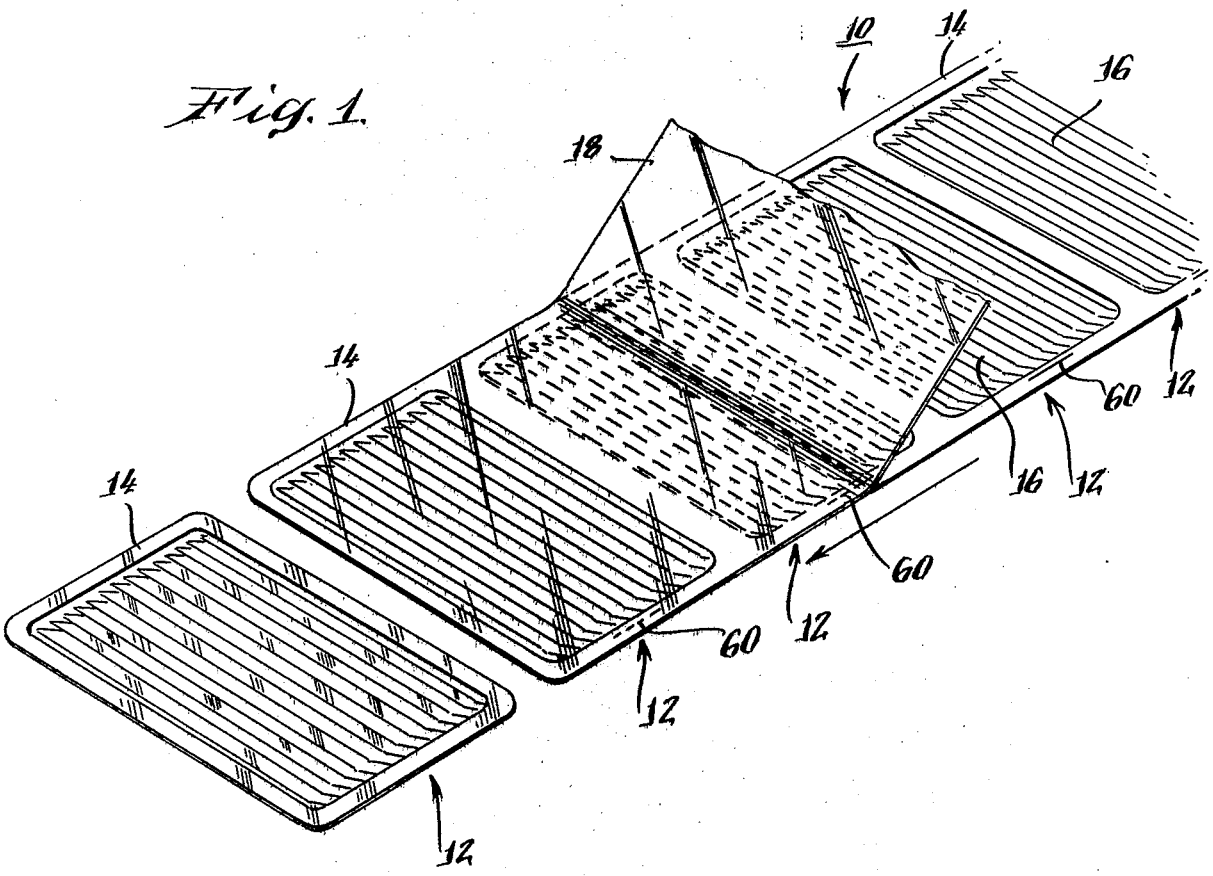
FIG. 1 is a perspective view showing several stages in the packaging sequence.

Referring now to FIG. 1, there is shown a bottom web 10 of flexible plastic packaging material which is conveyed from right-to-left along a horizontal path past a series of stations. At one such station (not shown herein, but located off to the right from FIG. 1), conventional means are utilized to form the lower web into cup-like receptacles 12 the upper openings of which can be seen in FIG. 1. Around these openings are the usual flanges 14, in the plane of the web.

The formed receptacles 12 are loaded with product, in this case shingled bacon 16. A top web 18 of flexible packaging material then is moved down towards the bottom web 10 and applied thereto, as by the usual lay-down roll. The two webs, and the contained product, are then advanced to a seal-and-evacuation head generally indicated at 20 in FIG. 3, and comprising vertically-reciprocable upper and lower members 22, 24.

Figures 3, 4:
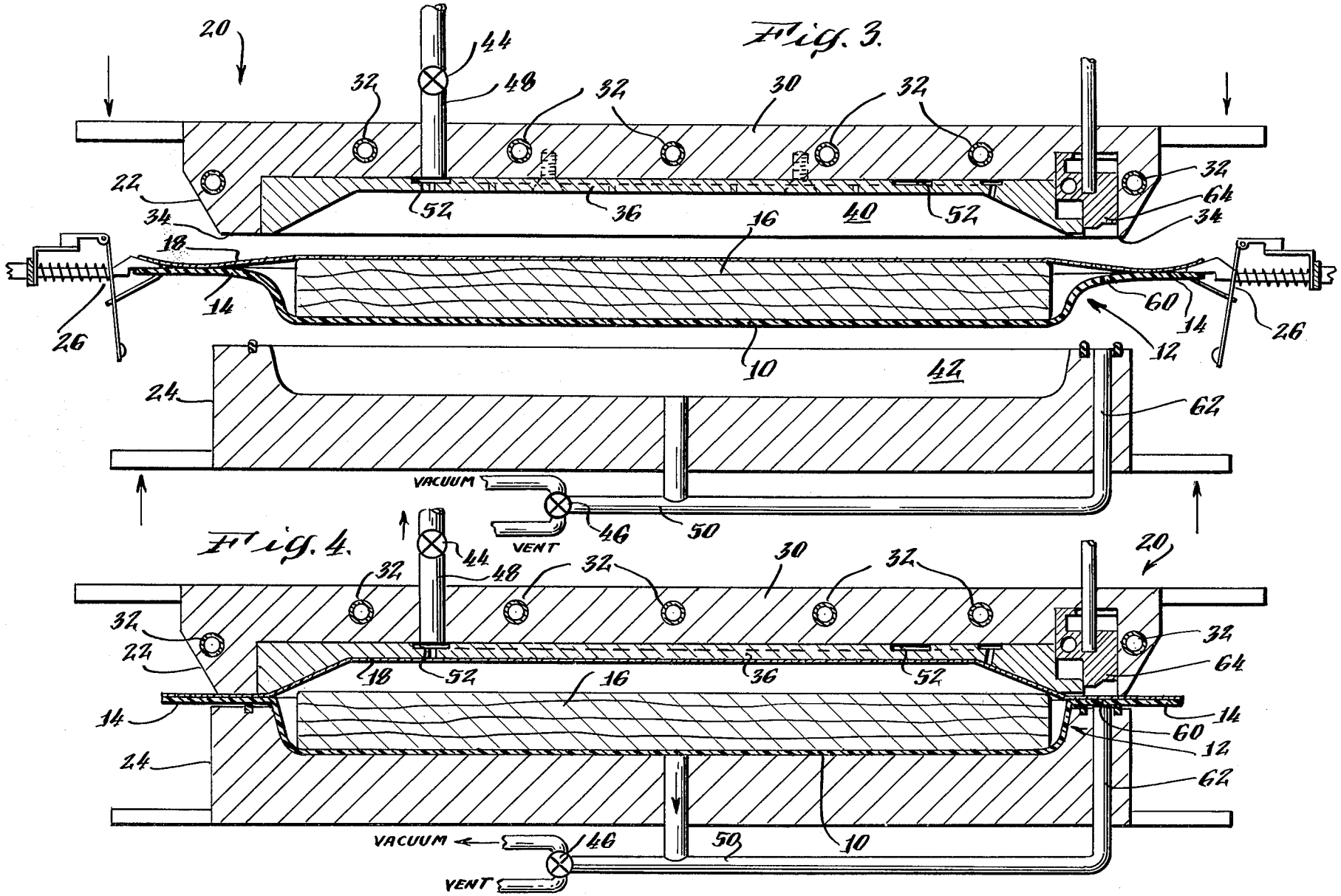
FIG. 3 is a cross-section view of the evacuation and seal head, shown with the two members thereof separated.
FIG. 4 is a cross-section like FIG. 3, but shown after the head has closed and vacuum has been applied.

As can be seen from FIG. 3, the bottom web 10 is supported for horizontal conveying movement by edge-clamps 26 of usual construction. The top web 18 rests somewhat limply on the product 16 which in this case protrudes a bit above the flanges 14 of the receptacle 12, e.g. a distance of perhaps ⅛ to 3/16 inch.

The upper member 22 comprises an outer part 30 carrying conventional heater elements 32 so that the downwardly-extending sides 34 of this part serve as an initial seal bar to seal the two webs 10 and 18 around the flange surrounding the receptacle opening when the members 22, 24 are reciprocated together as shown in FIG. 4. The upper member 22 also includes an inner web-heating insert 36, made of aluminum, and in non-insulated, heat-transfer contact with the outer initial seal-bar part 30; the function of this insert will be described below.

Figure 2:
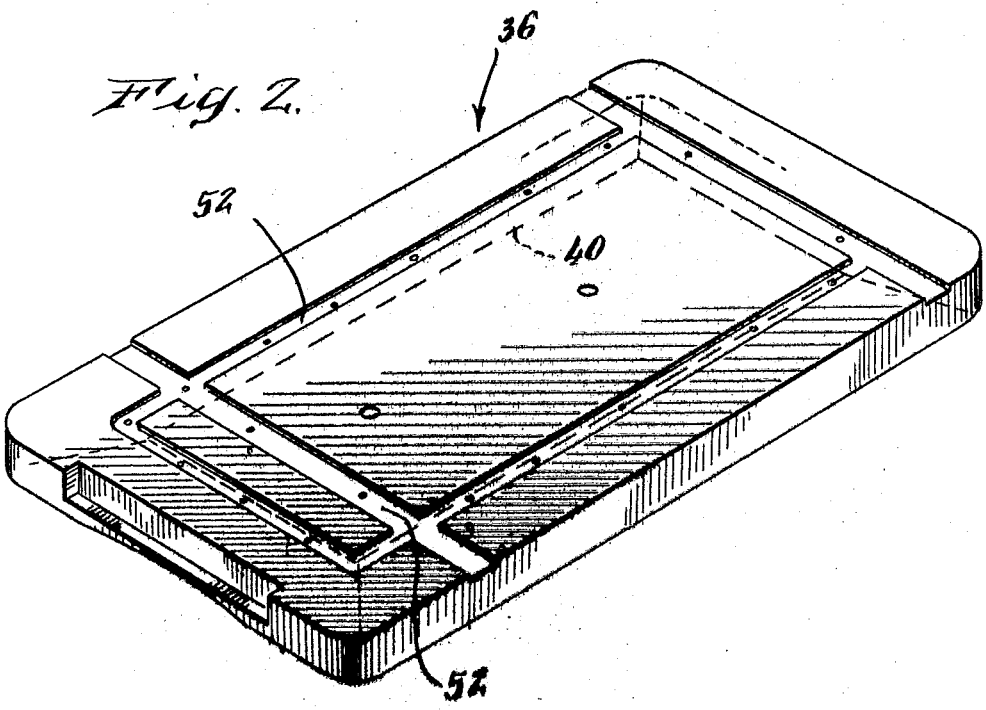
FIG. 2 is a perspective view of a heating insert for the upper member of the evacuation and seal head.
Figure 7:
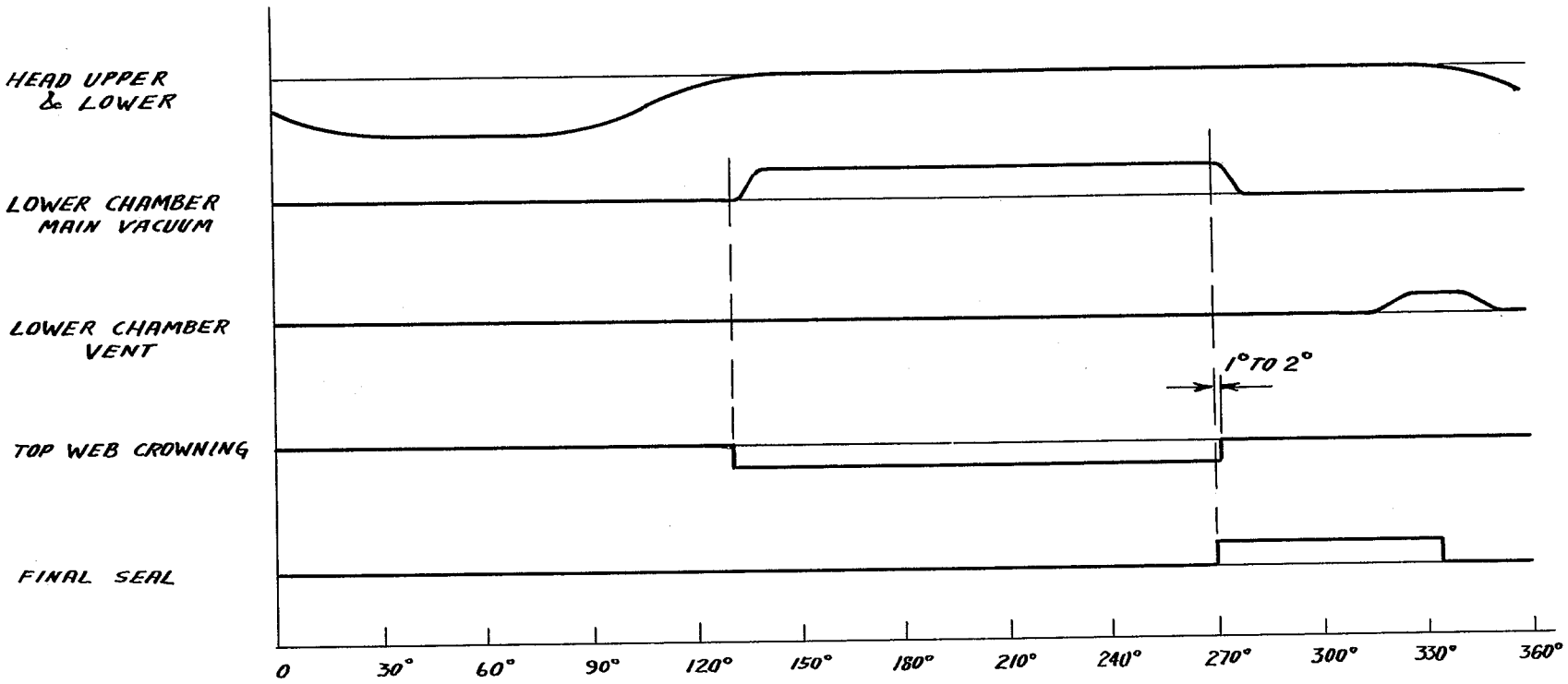
FIG. 7 is a diagram showing the timing interrelationships of certain events during the packaging cycle.

When the upper and lower members 22, 24 are together, as shown in FIG. 4, they form an airtight evacuation chamber surrounding the package. Vacuum is applied to the spaces 40, 42 above and below the package through the use of valves 44, 46 controlling vacuum lines 48, 50. The upper line 48 communicates with the spaces 40 through channels 52 in the insert 36 (see also FIG. 2), and through holes leading down from those channels. The valves 44, 46 apply vacuum at about the same time, as indicated in FIG. 7 which shows the actual timing relationship for a machine constructed in accordance with this invention. The lower chamber timing line is shown with curved leading and trailing edges only because the actual machine for which this chart applies used a cam-operated valve 46. The other valve was solenoid-operated giving rise to sharp leading and trailing-edges. In actuality, the vacuum from each may be applied at about the same rate, notwithstanding the more gentle curve shown for the lower chamber.

When vacuum is applied, the interior of the package is evacuated through an evacuation slit 60 (see also FIG. 1) positioned just above the outlet of a vacuum line 62 connected to line 50, at the side of the head 20. The spaces 40, 42 above and below the package are evacuated more rapidly than is the interior of the package, and for that reason the top web 18 is pushed up by the resulting differential pressure between the package interior and the upper spaces. The top web approaches and may advantageously momentarily engage the heated surface of the insert 36 as illustrated in FIG. 4. This surface preferably is polished to provide good heat transfer to the web. The temperature of the web is raised to a relatively high level providing for forming of the plastic material. The top web also will be slightly stretched, as it is forced against the smoothly contoured surface of the insert, thus serving to provide an amount of slack in the material.

Figure 5:
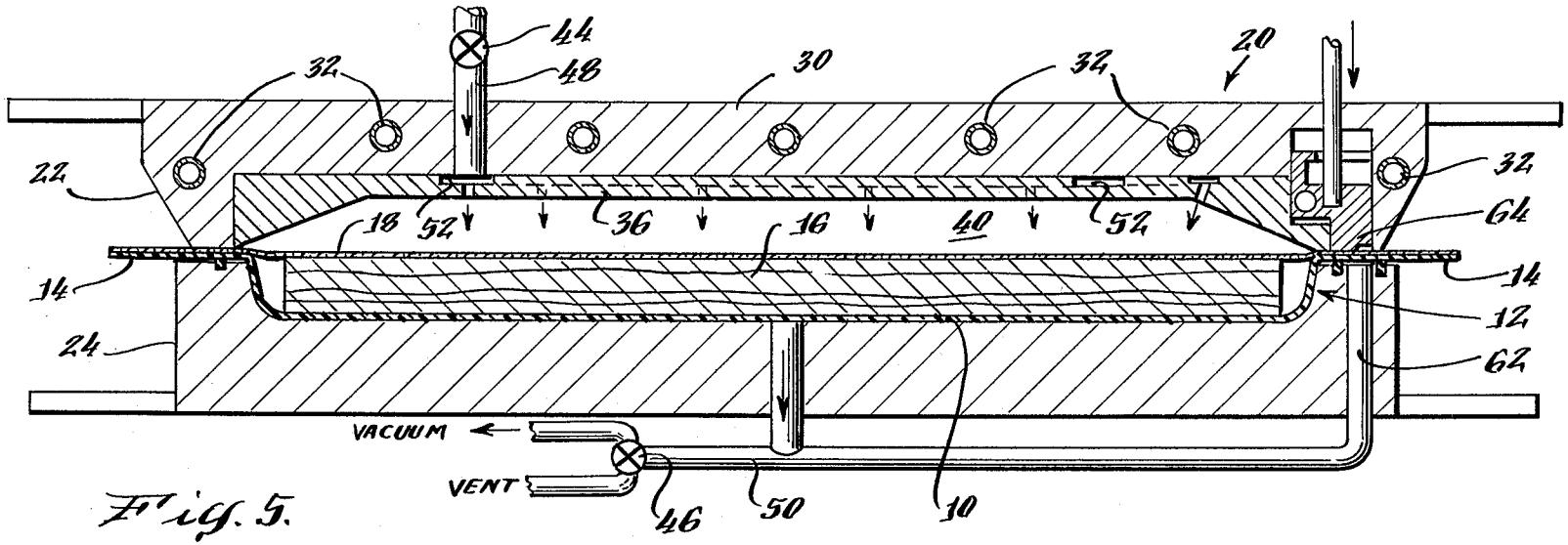
FIG. 5 is a cross-section like FIG. 4, shown after the sealing bar has sealed off the evacuation slit.

After the package is evacuated, a final seal bar 64 is shifted down by conventional air-cylinder operating means, to seal off the evacuation slit 60 as shown in FIG. 5. Almost simultaneously, the spaces above the top web 18 are vented to atmosphere (see FIG. 7, "top web crowning"), and the vacuum valve to the lower chamber is closed but the vacuum line is not yet vented to atmosphere, as indicated by the curve "lower chamber main vacuum" in FIG. 7. The initial inrush of air above the package tends to drive down both the top web 18 (already stretched somewhat by having been drawn up towards the insert 36), and the bacon 16, which is somewhat compressible. As can be seen from FIG. 5, the product and the top web now are about even with the plane of the flanges of the receptacle. In some cases, the product and top web may be below that plane.

After a further short period of time, the lower valve 46 is shifted from vacuum-off to vent position, at the time indicated by "lower chamber vent" in FIG. 7. The resulting inrush of atmospheric pressure applies an upwardly-directed force against the bottom web and the product, tending to move the product up. The final seal bar 64 then is retracted, and the vent to the lower spaces is closed. The upper and lower head members 22, 24 then move apart, and the completed package is shifted out from the head to be cut from the web, as illustrated in FIG. 1.

Figure 6:
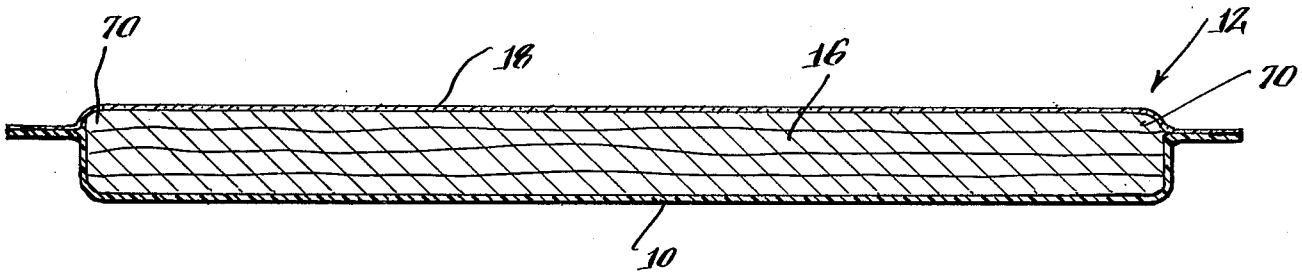
FIG. 6 is a view of the finished package.

FIG. 6 shows a cross-sectional view of the finished package where, it will be observed, an upper portion 70 of the product is located above the flanges surrounding the mouth of the receptacle. This upward disposition of the product has been referred to as "crowning," and provides significant benefits for certain products. In bacon packaging, for example, the resulting package is much better able to be placed in a conventional board-type container for presentment to the customer.

Although a specific preferred embodiment has been described in detail herein, this is not intended to be limiting of the invention since many modifications can be made without departing from the scope and spirit of the invention. For example, products other than bacon can be usefully crowned, for special applications. The products may in many instances lie initially within the receptacle with their upper surfaces below the flange line. Different types of packaging material also can be used, depending on a variety of factors. For such different products and different conditions, the timing of the sequential venting of the upper and lower spaces will differ from those shown herein. In some cases, the lower spaces should be vented before the upper spaces, since the intended result depends upon an upward force being directed against the lower web after the package has been sealed. Alternatively, as in the present application, the upper spaces may be vented first, in order to apply an initial downward force against the top web and the product, e.g. to prevent excessive force, due to venting the lower spaces, from jamming the product tightly up against the interior surface of the insert 36 and thereby badly misshaping the product. Thus in general it can be said that the desired results are achieved by selective sequential venting of the upper and lower spaces, in conjunction with heating of the upper web, especially in the same chamber in which the evacuation and final sealing take place.

We claim:

1. In vacuum packaging apparatus of the type wherein upper and lower continuous webs of plastic packaging material are transported past packaging stations where various operations are performed, and wherein the lower web is formed into receptacles with surrounding flanges, said receptacles being loaded with product and the top web thereafter being laid over the lower web to be sealed thereto to form vacuum packages;

apparatus for making crowned packages comprising:

evacuation-and-seal means having relatively reciprocable upper and lower means to surround the package and providing spaces above and below said package;

said evacuation-and-seal means including means to evacuate said spaces and said package;

said evacuation-and-seal means further including first heated means to seal said two webs together to make an hermetically-sealed package;

said upper means including means providing an enclosed region having a top surface located at a substantial vertical height above the line where said two webs are located and configured to accommodate movement of said product together with the top web upwards into said region;

said upper means further including second heated means at said top surface above the top web presenting a heated surface to said top web;

means operable during evacuation of said package to stretch the top web up said substantial vertical height to a position adjacent said heated surface to transfer heat to said top web to heat it to an elevated temperature providing for forming thereof; and means to selectively sequentially vent said upper and lower spaces to provide for shifting of said product to a final position in which a portion of the product and the top web is above said flanges, thereby to produce a crowned effect.

2. Apparatus as claimed in claim 1, wherein both said upper and lower means define an evacuation chamber;

said second heated means being positioned in the upper region of said chamber.

3. Apparatus as claimed in claim 2, wherein said second heated means comprises a flat, smooth plate.

4. Apparatus as claimed in claim 3, including means to evacuate the spaces above said top web at a rate relative to the evacuation of the interior of the package such that the differential pressure forces the top web up against the heated plate.

5. Apparatus as claimed in claim 1, wherein said means to selectively sequentially vent said spaces comprises first and second valve means connected in the vacuum lines leading to said spaces and adapted to be operated at different times in a packaging cycle.

* * * * *